US006921087B2

(12) United States Patent
Takahashi et al.

(10) Patent No.: US 6,921,087 B2
(45) Date of Patent: Jul. 26, 2005

(54) SEALING MECHANISM FOR VESSEL AND CAP TO BE USED IN THE MECHANISM

(75) Inventors: Masashi Takahashi, Kashiwa (JP); Tetsuo Yoshiwara, Matsudo (JP)

(73) Assignee: Nippon Tansan Gas Co., Ltd., Tokyo (JP)

( * ) Notice: Subject to any disclaimer, the term of this patent is extended or adjusted under 35 U.S.C. 154(b) by 1 day.

(21) Appl. No.: 10/286,486

(22) Filed: Nov. 1, 2002

(65) Prior Publication Data

US 2004/0036229 A1 Feb. 26, 2004

(30) Foreign Application Priority Data

Aug. 20, 2002 (JP) ..... 2002-238815

(51) Int. Cl.[7] ..... F16J 15/02

(52) U.S. Cl. ..... 277/628; 277/628; 222/81; 222/83; 206/219; 206/221

(58) Field of Search ..... 222/81, 83, 129, 222/511, 510; 206/219, 221; 277/628

(56) References Cited

U.S. PATENT DOCUMENTS 5,950,819 A * 9/1999 Sellars ..... 206/221
6,003,728 A * 12/1999 Elliott ..... 222/81

FOREIGN PATENT DOCUMENTS

| | | |
|---|---|---|
| JP | 44-12957 | 5/1969 |
| JP | 50-18844 | 6/1975 |
| JP | 50-18846 | 6/1975 |
| JP | 50-18847 | 6/1975 |
| JP | 50-18848 | 6/1975 |
| JP | 8-91418 | 4/1996 |

* cited by examiner

*Primary Examiner*—Enoch Peavey
(74) *Attorney, Agent, or Firm*—Koda & Androlia

(57) ABSTRACT

A cap has a plug portion, a seal plug and a sleeve. At the plug portion a side and a cylindrical wall project from a top board. An inner circumferential surface of the side wall fits on an outer circumferential surface of an opening portion of a vessel and covers the opening portion with the top board. The cylindrical wall forms a receiving chamber having an opening mouth at its under end face. The seal plug seals the opening mouth. The sleeve is loosely fitted on the cylindrical wall and opens the opening mouth by separating the seal plug from the cylindrical wall at relative movement of the cap. A sepal portion on the outer circumference of the sleeve is larger than inner diameter of the opening portion at its outer diameter and has flexibility to pass the inner diameter bending so as to avoid backward moving.

18 Claims, 4 Drawing Sheets

SEALING MECHANISM FOR VESSEL AND CAP TO BE USED IN THE MECHANISM

BACKGROUND OF THE INVENTION

1. Technical Field of the Invention

This invention relates to such a sealing mechanism for vessel that enables to preserve liquid consists of several raw materials, a refreshing drink for example, in single vessel isolating the consisting raw materials from each other in condition that they can be mixed when they are used, and relates to a cap to be used in the mechanism which cap having receiving chamber for raw material.

2. Prior Art

A medicine to be used mixing two agents, a refreshing drink produced by mixing raw material into liquid or the like occasionally changes in quality in case where they have not used or consumed long time after they were mixed, because the mixed agents reacts or the raw material mixed into the liquid is deteriorated by sunlight or oxygen in air. Therefore, as a way to preserve these liquid or the like used or consumed mixing several raw materials and so on in condition their original qualities are kept, a method to separately preserve raw material and liquid to be mixed by providing a cap for sealing vessel to include the liquid inside with a receiving chamber for the raw material is contrived. Then many kinds of means for the method are contrived and there are such means described below as examples.

As the first means, there is a means disclosed in Japanese patent application laid-open publication No. H08-91418. However, according to this means, a cap of a vessel consists of a movable portion having a receiving chamber and a fixed portion stable to the vessel, and the movable portion to seal the vessel is screwed and fixed on the fixed portion in its structure. Therefore, it is impossible to fix a sealing check member (usually called as a cut-ring) to be obligatory put in purpose of maintaining hygiene. The cut-ring is a circular member connected via connecting members to bottom side of the cap screwed and fixed on the vessel which connecting members can be cut in rotation of the cap, and by engaging the cut-ring on the vessel the cap is not able to be opened without cutting the connecting members. Therefore, it brings an effect of prevent the cap from being opened by third party in wrong purpose in distribution process.

However, in case the movable portion to seal the vessel is screwed and fixed on the fixed portion, there is a problem that the fixed portion itself can be put off the vessel in spite of the cut-ring engaging on the fixed portion. It is possible to apply such a method that connects the cut-ring to the fixed portion. However, a part of the fixed portion has to be positioned inside opening portion of the vessel to open the receiving chamber and such the structure that the opening portion of the vessel is held from its both inner and outer sides is required. Therefore, because the structure is brought to be complex, there is a problem of cost to make structure wherein the fixed portion is screwed on the vessel. Accordingly, the cut-ring being able to be brought in effect as being united with a member to be screwed on the vessel is hardly applied to this means wherein the portion to seal the vessel is not screwed directly on the vessel in structure.

Further, as being such a complex structure, there is a problem that the cost tends to be high because of requiring constructing processes and so on.

Therefore, it is preferred that a cap to seal a vessel is screwed directly on the vessel. Then, as such a means, there is a means disclosed in Japanese utility model publication No. S44-12957 (called "the second prior means" below), or there are means disclosed in Japanese utility model publication Nos. S50-18846, S50-18847 and S50-18848 (called "the third prior means" below), further there is a means disclosed in Japanese utility model publication No. 50-18844 (called "the fourth prior means" below).

At the second prior means described above, inside a vessel body a narrow portion to open a receiving chamber is formed. Here, as ways to form the narrow portion, tightly inserting a cylindrical packing having funnel-shaped bottom portion inside a mouth portion of the body, or forming a protuberant rim projecting inside on a root portion of a bottle neck of the body are disclosed.

At the third prior means described above, an inner plug forming a receiving chamber is provided at a cap of a vessel and a member for closing and opening is vertically projected from a bottom side of a top wall of the cap. When the cap is removed from the vessel, while the inner plug separates from the top wall and is left on a top portion of the vessel, the member for closing and opening leaves from a bottom face of the inner plug, a leak hole formed on the bottom face is opened and raw material reserved in the receiving chamber is to be discharged.

At the fourth prior means described above, a receiving chamber formed at a cap is sealed via an inner cap characterized in structure. Here, the inner cap has a bottom plate being larger in diameter than inner diameter of an opening portion of a vessel and having flexible rim portion, and the rim portion of the bottom plate is shaped to hardly bend downward at settled condition. When the cap seals the vessel, the rim portion of the bottom plate of the inner cap inserted with the receiving chamber into the opening portion bents upwardly and shrinks, but as passes the opening portion and reaches to extended wide portion it returns to original state and is fixed. When the vessel is opened, while the cap moves upwardly, the inner cap is held inside the vessel as its rim portion of the bottom plate engages to inner surface of the opening portion and is fixed there, but at last the inner cap drops off the receiving chamber and the receiving chamber is to be opened.

However, as the second prior means requires a vessel of special shape having a structure to open the receiving chamber, vessels widely distributed in market are not able to be used and there is a problem that cost of the vessel is increased.

According to the way of tightly inserting the packing inside the vessel body, ordinary vessels are able to be used. However, outer circumferential surface of the packing has to be pressed tightly to the inner surface of the vessel for tightly inserting the packing into the vessel having smooth inner surface, while the cap itself has to be screwed on the vessel. Namely, when the cap seals the vessel the packing has to be inserted being rotated, and there is a problem that the sealing process is to be extremely difficult.

Further, according to the third prior means, it is impossible to tightly fix the inner plug to the top wall which plug has to be separated from the top wall only by rotation of the cap, and the receiving chamber formed by the inner plug and the top wall is not able to be sealed completely. Therefore, it is difficult to completely prevent raw material reserved in the receiving chamber from oxidation, brownishness, aging and deterioration caused by oxygen in the air.

Further more, according to the fourth prior means, in case where the rim portion of the bottom plate of the inner cap is made to bent downward too much by production error and so on, there is a fear that the inner cap is stuck in the opening portion as it moves upwardly with the cap when the vessel is opened and plugs the vessel without it drops from there.

Accordingly, the present invention aims to provide a sealing mechanism for vessel which mechanism enables to prevent raw material and liquid from quality deterioration by using a cap being able to be fixed easily and directly to a vessel to separately preserve the raw material and the liquid to be mixed, and enables to surely discharge the raw materials preserved in a receiving chamber without plugging the vessel, and also aims to provide a cap to be used in the mechanism.

SUMMARY OF THE INVENTION

A sealing mechanism for a vessel which mechanism relating to the present invention is characterized in that:

the vessel and a cap are provided, which vessel having an opening portion and which cap being a characteristic cap relating to the prevent invention.

Then, the cap relating to the present invention is characterized in that:

a plug portion, a seal plug and a sleeve are provided, the plug portion has a top board to cover the opening portion, a side wall projecting from the top board along axis of the plug portion which wall has an inner circumferential surface fits on an outer circumferential surface of the opening portion, and a cylindrical wall forming a receiving chamber having an opening mouth at its under end surface which wall projecting from the top board at inner side of the side wall, the seal plug is to be fixed on the cylindrical wall to seal the opening mouth and its outer diameter is larger than outer diameter of the cylindrical wall, the sleeve is loosely fitted on the cylindrical wall and has a flexible sepal portion on the outer circumference which portion has outer diameter larger than inner diameter of the opening portion and passes the inner diameter bending so as to avoid backward moving, and at relative movement of the cap to the vessel toward direction where they separate from each other, the seal plug is separated by the sleeve from the cylindrical wall and the opening mouth is to be opened.

According to the cap, the plug portion having the top board to cover the vessel is constructed to fit to an outer circumferential surface of the opening portion by an inner circumferential surface of the side wall projecting from the top board along its axis. Further, the receiving chamber is formed by the cylindrical wall projecting from the top board at inner side of the side wall and has a structure wherein the seal plug to seal the receiving chamber is separated by the sleeve from the cylindrical wall which sleeve is loosely fitted on the cylindrical wall. Therefore, the plug portion to seal the vessel is able to be screwed directly on the vessel in spite of having the receiving chamber. Here, fitting of the inner circumferential surface of the side wall to the outer circumferential surface of the opening portion is assumed to be screwing in the most case considering to fix the cut-ring, however, it is not limited to be screwing but may be joining or other combining state.

Regarding the sleeve, it is prevented from being pulled out from the vessel by the sepal portion having outer diameter larger than inner diameter of the opening portion, and also the sepal portion has flexibility to passes the inner diameter bending so as to avoid backward moving. Then, because of its structure, it is able to be inserted inside the vessel easily but not to be pulled out from the vessel after inserting. Therefore, according to the cap, even if the plug portion and the sleeve are united as one body, it is possible to be screwed easily and directly to the vessel. Then, according to the sealing mechanism using the cap, the cap to seal the vessel where the raw material and the liquid to be mixed are separately preserved is able to be fixed easily and directly to the vessel.

Further, according to the cap, as the receiving chamber is formed by the cylindrical wall projecting from the top board and the opening mouth at under end face is sealed by the seal plug, its inside is completely shut from the outside air. Then, according to the sealing mechanism using the cap, it is possible to prevent raw material preserved in the receiving chamber from deterioration due to the oxygen in the air or other phenomena.

Furthermore, according to the cap, the seal plug for the receiving chamber is separated from the cylindrical wall by the sleeve in relative movement of the cap to the vessel toward direction to separate from the vessel, and opens the opening mouth of the receiving chamber without touching to the inner surface of the opening portion. Therefore, according to the seal mechanism using the cap, there is not such fear that the cap is stuck in the inner surface of the opening portion and plugs the vessel.

The opening portion may have a circular groove and the sleeve may have a circular protruding portion on outer circumferential face which portion engages with the circular groove.

To do like this, as engaging strength of the sleeve to the vessel is increased and effect of avoiding to be pulled out is enhanced, the receiving chamber is more surely opened.

The sleeve may have a flange formed on its upper end surface which flange engages on an end surface of the opening portion.

To do like this, after the seal plug separates from the cylindrical wall, the sleeve is prevented from dropping inside the vessel with the seal plug. Especially, this flange is effective in case the sepal portion of the sleeve engages to a shoulder portion positioning at bottom of the opening portion and whose inner diameter is enlarged. In case of having the circular protruding portion engages with the circular groove or in case the sepal portion stays in the opening portion and engages there, the sleeve is prevented from being pulled out the vessel or dropping inside the vessel by the circular groove or the sepal portion. However, in case only engaging strength of the circular protruding portion or the sepal portion to the opening portion is not enough to avoid dropping off, the flange may be formed to surly avoid dropping off.

The sleeve and the seal plug may be connected.

To do like this, the seal plug separated from the cylindrical wall is prevented from dropping inside the vessel.

The sleeve, the seal plug and the vessel may be made of same material. In case the sleeve and the seal plug are connected, the sleeve, the seal plug, a connecting portion of the sleeve and the seal plug and the vessel may be made of same material.

To do like this, the vessel is collected and recycled effectively.

DETAILED DESCRIPTION OF THE PREFERRED EMBODIMENT

Figure 1:
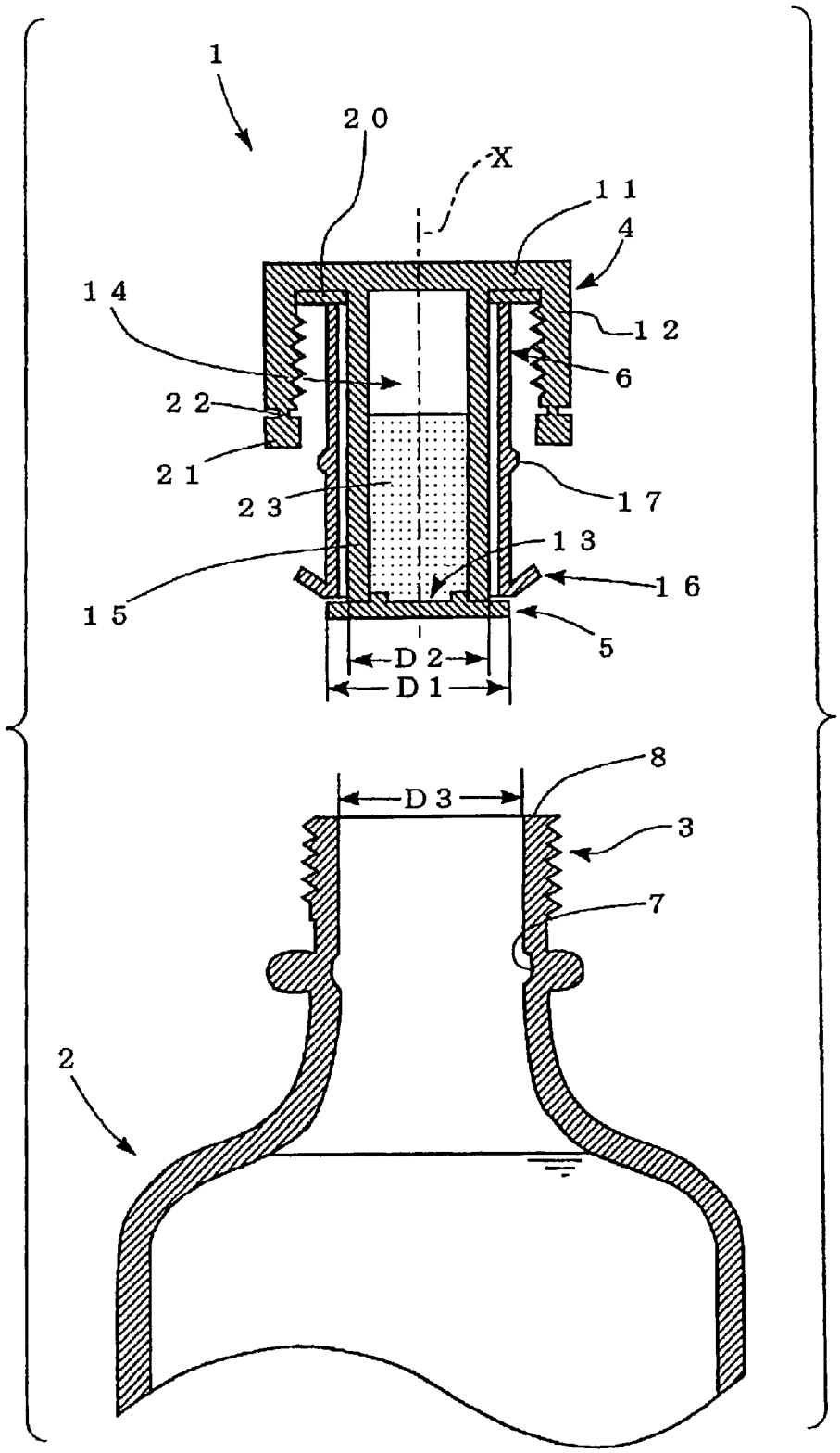
FIG. 1 is a front section shows a cap used for sealing mechanism for vessel which mechanism relates to the present invention and a vessel to be sealed by the cap.
Figure 2A:
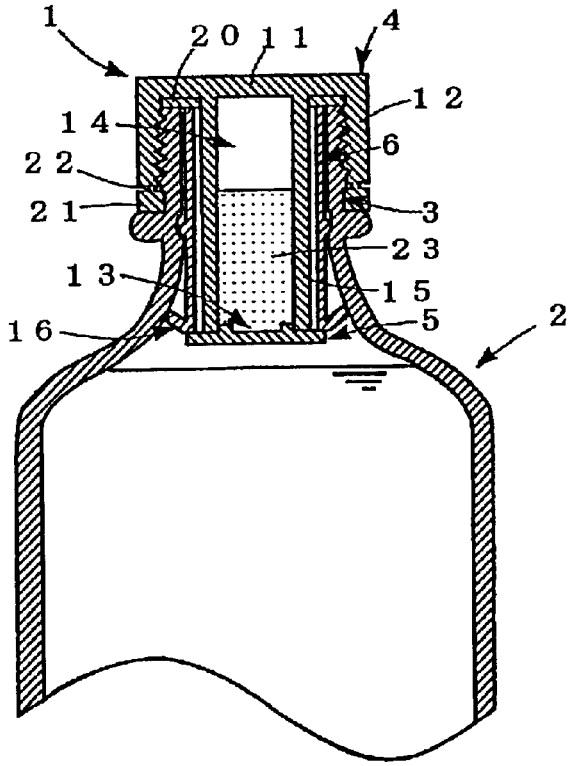
FIG. 2 shows conditions where the cap is used, and FIG. 2(*a*) is a front section of condition before the receiving chamber is opened and FIG. 2(*b*) is a front section of condition after the receiving chamber is opened.
Figure 2B:
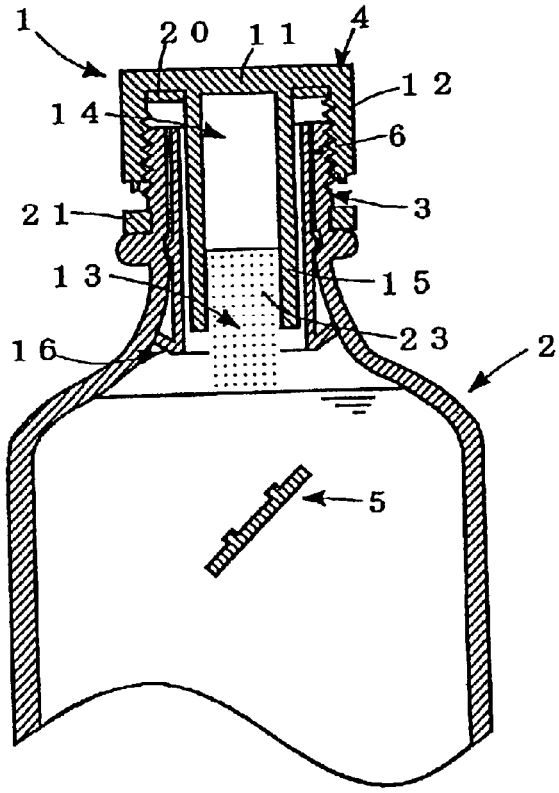

In FIGS. 1 and 2, an embodiment of cap to be used in sealing mechanism for vessel in respect of the present invention is shown.

A cap 1 is to be used in a sealing mechanism for a vessel 2 and has a plug portion 4, a seal plug 5 and a sleeve 6.

The plug portion 4 has a top board 11 to cover an opening portion 3 of the vessel 2, a side wall 12 projecting from the top board 11 along axis X of the plug portion 4 which wall has an inner circumferential surface fits on an outer circumferential surface of the opening portion 3, and a cylindrical wall 15 forming a receiving chamber 14 having an opening mouth 13 at its under end face which wall projects from the top board 11 at inner side of the side wall 12. Further, on bottom side of the top board 11, a packing 20 is attached. Furthermore, to under edge of the side wall 12, a cut-ring 21 is connected.

The seal plug 5 is to be fixed on the cylindrical wall 15 to seal the opening mouth 13 and its outer diameter D1 is larger than outer diameter D2 of the cylindrical wall 15.

The sleeve 6 is loosely fitted on the cylindrical wall 15 and has a flexible sepal portion 16 on the outer circumference which portion has outer diameter larger than inner diameter D3 of the opening portion 3 and passes the inner diameter D3 bending so as to avoid backward moving.

Further, the cap 1 is to be screwed and fixed on the vessel 2 by rotation to the vessel 2 and is to cover it. Namely, the plug portion 4 is to be screwed and fixed to the vessel 2 by rotation inserting the sleeve 6 and the receiving chamber 14 into the opening portion 3 of the vessel 2, and then the top board 11 is to cover the opening portion 3 of the vessel 2. Here, as the sleeve 6 contacts inner surface of the opening portion 3 by the sepal portion 16 only, contacting surface with the opening portion 3 is small and the rotation is not obstructed.

Furthermore, in condition where the cap 1 seals the vessel 2, the cut-ring 21 engages to the vessel 2 as shown in FIG. 2(*a*) and it is not able to be opened without cutting a connecting portion 22. Then, in condition where the vessel 2 is opened by cutting the connecting portion 22 as shown in FIG. 2(*b*), the seal plug 5 is separated by the sleeve 6 from the cylindrical wall 15 and the opening mouth 13 is to be opened in relative movement of the cap 1 to the vessel 2 toward direction to separate from the vessel 2.

At the cap 1, the plug portion 4 to seal the vessel 2 is able to be screwed directly on the vessel 2 in spite of having the receiving chamber 14. Regarding the sleeve 6, it is prevented from being pulled out from the vessel 2 by the sepal portion 16 having outer diameter larger than inner diameter D3 of the opening portion 3, and also the sepal portion 16 has flexibility to passes the inner diameter D3 bending so as to avoid backward moving. Then, because of its structure, it is able to be inserted inside the vessel 2 easily but not to be pulled out from the vessel 2 after inserting. Therefore, according to the cap 1, even if the plug portion 4 and the sleeve 6 are united as one body, it is possible to be screwed easily and directly to the vessel 2. Then, according to the sealing mechanism using the cap 1, the cap 1 to seal the vessel 2 where the raw material and the liquid to be mixed are separately preserved is able to be fixed easily and directly to the vessel 2.

Further, according to the cap 1, as the receiving chamber 14 is formed by the cylindrical wall 15 projecting from the top board 11 and the opening mouth 13 at under end face is sealed by the seal plug 5, its inside is completely shut from the outside air. Then, according to the sealing mechanism using the cap 1, it is possible to prevent raw material preserved in the receiving chamber 14 from deterioration due to the oxygen in the air or other phenomena.

Furthermore, according to the cap 1, the seal plug 5 for the receiving chamber 14 is separated from the cylindrical wall 15 by the sleeve 6 in relative movement of the cap 1 to the vessel 2 toward direction to separate from the vessel 2, and opens the opening mouth 13 of the receiving chamber 14 without touching to the inner surface of the opening portion 3. Therefore, according to the seal mechanism using the cap 1, there is not such fear that the cap 1 is stuck in the inner surface of the opening portion 3 and plugs the vessel 2.

The opening portion 3 has a circular groove 7 and the sleeve 6 has a circular protruding portion 17 on outer circumferential face which portion engages with the circular groove 7.

In this case, as engaging strength of the sleeve 6 to the vessel 2 is increased and effect of avoiding to be pulled out is enhanced, the receiving chamber 14 is more surely opened.

The sleeve 6, the seal plug 5 and the vessel 2 are made of same material.

In this ease, the vessel 2 is collected and recycled effectively.

In the receiving chamber 14, raw material 23 is charged. The raw material 23 should be charged before the vessel 2 is sealed but its state is not restricted and powder, solid, liquid or any other state is acceptable. Here, as powder material, for example, green tea, coffee, black tea, enriched mineral, an extracted mineral from the water in the depths of the sea, healthy food, medicine, an extracted fruit juice, dairy products, alcohol, an extracted vegetable, vitamin, sugar, herbs or ferment bacilli may be charged. As solid material, green tea, coffee, black tea, enriched mineral, an extracted mineral from the water in the depths of the sea, healthy food, medicine, an extracted fruit juice, or dairy products may be charged. Further, as liquid material, for example, green tea, coffee, black tea, enriched mineral, an extracted mineral from the water in the depths of the sea, healthy food, medicine, an extracted fruit juice, or dairy products may be charged.

Charging of the raw material 23 is able to be achieved by sealing the opening mouth 13 with the seal plug 5 after putting the raw material 23 into the receiving chamber 14 in condition the sleeve 6 is loosely fitted on the cylindrical wall 15 and the opening mouth 13 is faced upward. Here, it is preferred the air inside the receiving chamber 14 is removed and only the raw material 23 is charged. In that case, quality of the raw material 23 is able to be kept in good condition.

Further, in case the raw material 23 is powder, it is preferred dehydrating treatment has been conducted. In that case, solidification in the receiving chamber 14 is able to be avoided.

It is further preferred the raw material 23 is charged into the receiving chamber 14 with an inert gas. In that case, quality of the raw material 23 is able to be kept in better condition.

Figure 3:
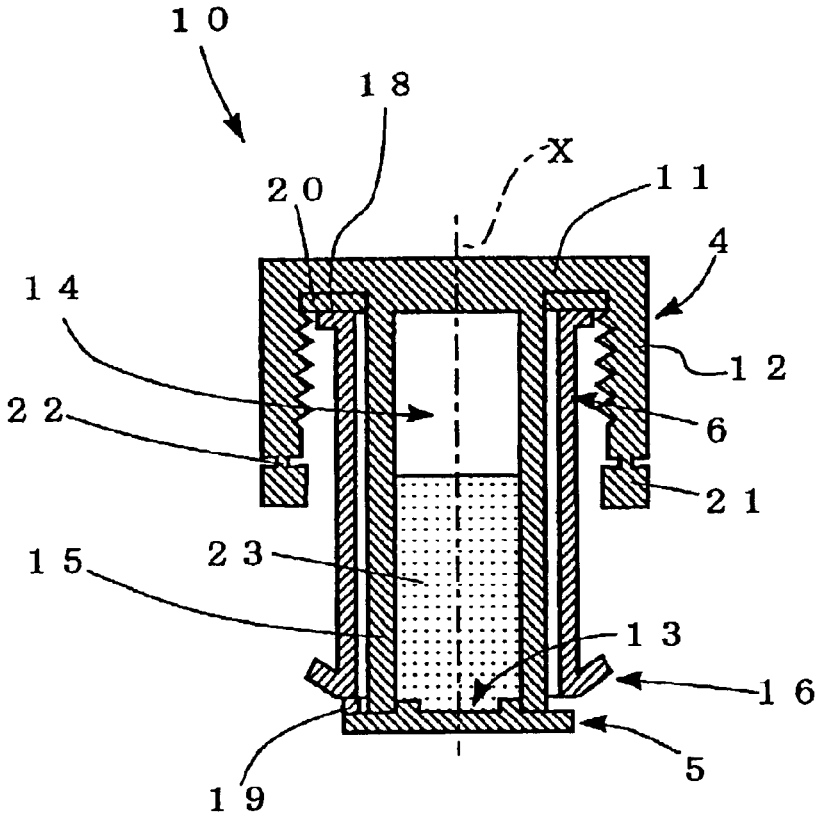
FIG. 3 is a front section of another embodiment of the cap used for sealing mechanism of vessel which mechanism relating to the present invention.
Figure 4A:
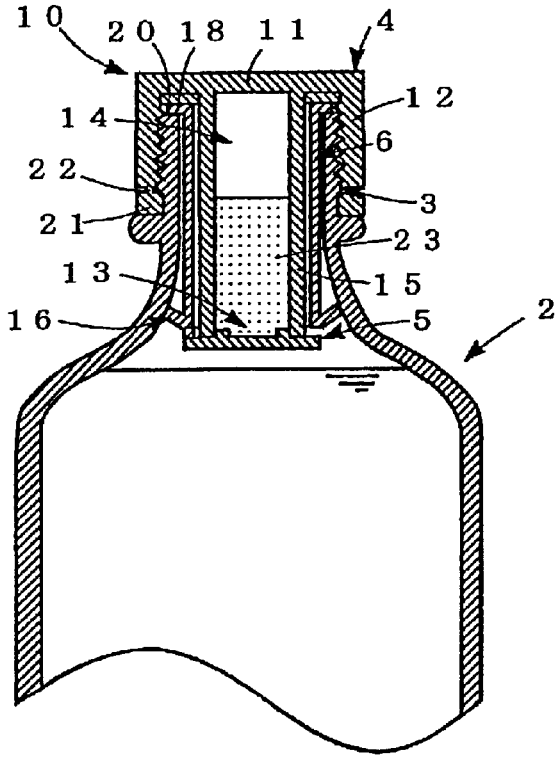
FIG. 4 shows conditions where the cap is used, and FIG. 4(*a*) is a front section of condition before the receiving chamber is opened and FIG. 4(*b*) is a front section of condition after the receiving chamber is opened.
Figure 4B:
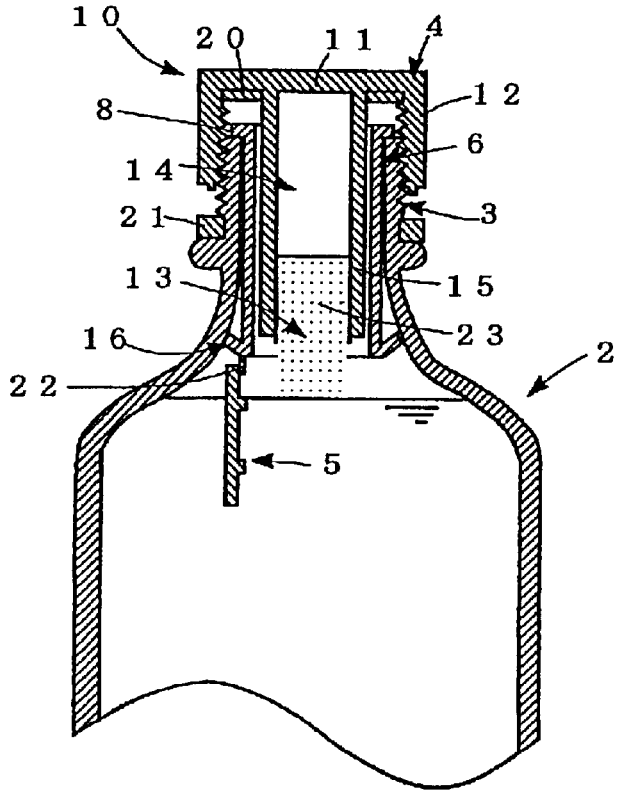

In FIGS. 3 and 4, another embodiment of cap to be used in sealing mechanism for vessel in respect of the present invention is shown. FIG. 3 is a front section of the cap. FIG. 4 shows conditions where the cap is used, and (a) is a front section of condition before the receiving chamber is opened and (b) is a front section of condition after the receiving chamber is opened.

The cap 10 shown in FIGS. 3 and 4 is different from the cap 1 as not having the circular protruding portion 17 at the sleeve 6 but having a flange 18 formed on its upper end surface instead. The flange 18 is to engage on an end surface 8 of the opening portion 3. Because the structures of other parts are as same as the cap 1, same remarks are put on the corresponding portions and their explanation is to be omitted from description below.

According to the cap 10, after the seal plug 5 separates from the cylindrical wall 15, the sleeve 6 is prevented from dropping inside the vessel 2 with the seal plug 5. The sleeve 6 of the cap 1 is prevented from being pulled out the vessel 2 and dropping inside the vessel 2 by the circular protruding portion 17, and in this case the flange 18 is not need. However, in case only engaging strength of the circular protruding portion 17 to the circular groove 7 is not enough to avoid dropping off, the flange 18 may be formed to surly avoid the dropping off.

At the cap 10, the sleeve 6 and the seal plug 5 are connected.

In this case, the seal plug 5 separated from the cylindrical wall 15 is prevented from dropping inside the vessel 2.

The sleeve 6, the seal plug 5, a connecting portion 19 of the sleeve 6 and the seal plug 5 and the vessel 2 are made of same material.

In this case, the vessel 2 is collected and recycled effectively.

EFFECTS OF THE INVENTION

According to the cap relating to the present invention, the plug portion to seal the vessel is able to be screwed directly on the vessel in spite of having the receiving chamber, and further, even if the plug portion and the sleeve are united as one body, it is possible to be screwed easily and directly to the vessel. Then, according to the sealing mechanism using the cap which mechanism relates to the present invention and, the cap to seal the vessel where the raw material and the liquid to be mixed are separately preserved is able to be fixed easily and directly to the vessel.

Further, according to the cap relating to the present invention, as the receiving chamber is formed by the cylindrical wall projecting from the top board and the opening mouth at under end face is sealed by the seal plug, its inside is completely shut from the outside air. Then, according to the sealing mechanism relating to the present invention and using the cap, it is possible to prevent raw material preserved in the receiving chamber from deterioration due to the oxygen in the air or other phenomena.

Furthermore, according to the cap relating to the present invention, the seal plug for the receiving chamber is separated from the cylindrical wall by the sleeve in relative movement of the cap to the vessel toward direction to separate from the vessel, and opens the opening mouth of the receiving chamber without touching to the inner surface of the opening portion. Therefore, according to the seal mechanism relating to the present invention and using the cap, there is not such fear that the cap is stuck in the inner surface of the opening portion and plugs the vessel.

Furthermore, according to the present invention, as engaging strength of the sleeve to the vessel is increased and effect of avoiding to be pulled out is enhanced, the receiving chamber is more surely opened.

Furthermore, according to the present invention, after the seal plug separates from the cylindrical wall, the sleeve is prevented from dropping inside the vessel with the seal plug.

Furthermore, according to the present invention, the seal plug separated from the cylindrical wall is prevented from dropping inside the vessel.

Furthermore, according to the present invention, the vessel is collected and recycled effectively.

What is claimed is:

1. A scaling mechanism for a vessel (2) which mechanism characterized in that:

said vessel (2) and a cap (1) are provided, which vessel (2) having an opening portion (3) and which cap (1) having a plug portion (4), a seal plug (5) arid a sleeve (6), said plug portion (4) has a top board (11) to cover said opening portion (3), a side wall (12) projecting from said top board (11) along axis (X) of said plug portion (4) and the side wall (12) is directly fitted on an outer circumferential surface of said opening portion (3) of the vessel (2), and a cylindrical wall (15) forming a receiving chamber (14) having an opening mouth (13) at its under end face which wall projects from said top board (11) at inner side of said side wall (12), said seal plug (5) is to be fixed on said cylindrical wall (15) to seal said opening mouth (13) and its outer diameter (D1) is larger than outer diameter (D2) of said cylindrical wall (15), said sleeve (6) is loosely fitted on said cylindrical wall (15) and has a flexible sepal portion (16) on said outer circumference which portion baa outer diameter larger than inner diameter (D3) of said opening portion (3) and passes said inner diameter (D3) bending so as to avoid backward moving, and at relative movement of said cap (1) to said vessel (2) toward direction where they separate from each other, said seal plug (5) is separated by said sleeve (6) from said cylindrical wall (15) and said opening mouth (13) is to be opened.

2. A sealing mechanism for a vessel (2) which mechanism characterized in that:

said vessel (2) and a can (1) are provided, which vessel (2) having an opening portion (3) and which cap (1) having a plug portion (4), a seal plug (5) and a sleeve (6), said plug portion (4) has a top board (11) to cover said opening portion (3), a side wall (12) projecting from said ton board (11) along axis (X) of said plug portion (4) which wall has an inner circumferential surface fits on an outer circumferential surface of said opening portion (3), and a cylindrical wall (15) forming a receiving chamber (14) having an opening mouth (13) at its under end face which wail projects from said top board (11) at inner side of said side wall (12), said seal plug (5) is to be fixed on said cylindrical wall (15) to seal said opening mouth (13) and its outer diameter (D1) is larger than outer diameter (D2) of said cylindrical wall (15), said sleeve (6) is loosely fitted on said cylindrical wall (15) and has a flexible sepal portion (16) on said outer circumference which portion has outer diameter larger than inner diameter (D3) of said opening portion (3) and passes said inner diameter (D3) bending so as to avoid backward moving, and at relative movement of said cap (1) to said vessel (2) toward direction where they separate from each other, said seal plug (5) is separated by said sleeve (6) from said cylindrical wall (15) and said opening mouth (13) to be opened, and wherein said opening portion (3) has a circular groove (7) and said sleeve (6) has a circular protruding portion (17) on outer circumferential face which portion engages with said circular groove (7).

3. A sealing mechanism as claimed in claim 2 wherein said sleeve (6) has a flange (18) formed on its upper end surface which flange engages on an end surface (8) of said opening portion (3).

4. A sealing mechanism as claimed in claim 2 wherein said sleeve (6) and said seal plug (5) are connected.

5. A sealing mechanism as claimed in claim 2 wherein said sleeve (6), said seal plug (5) and said vessel (2) are made of same material.

6. A sealing mechanism as claimed in claim 4 wherein said sleeve (6), said seal plug (5), a connecting portion (19) of said sleeve (6) and said seal plug (5) and said vessel (2) are made of same material.

7. A cap to be used in a sealing mechanism for vessel (2) which cap characterized in that:

a plug portion (4), a seal plug (5) and a sleeve (6) are provided, said plug portion (4) has a top board (11) to cover an opening portion (3) of said vessel (2), a side wall (12) projecting from said top board (11) along axis (X) of said plug portion (4) the side wall (12) is directly fitted on an outer circumferential surface of said opening portion (3) of the vessel (2), and a cylindrical wall (15) forming a receiving chamber (14) having an opening mouth (13) at its under end face which wall projects from said top board (11) at inner aide of said side wall (12), said seal plug (5) is to be fixed on said cylindrical wall (15) to seal said opening mouth (13) and its outer diameter (D1) is larger than outer diameter (D2) of said cylindrical wall (15), said sleeve (6) is loosely fitted on maid cylindrical wall (15) and has a flexible sepal portion (16) on aaid outer circumference which portion has outer diameter larger than inner diameter (D3) of said opening portion (3) and passes said inner diameter (D3) bending so as to avoid backward moving, and in relative movement to said vessel (2) toward direction to separate from said vessel (2), said meal plug (5) is separated by said sleeve (6) from maid cylindrical wall (15) and said opening mouth (13) is to be opened.

8. A cap to be used in a sealing mechanism for vessel (2) which can characterized in that:

a plug portion (4), a seal plug (5) and a sleeve (6) are provided, said plug portion (4) has a top board (11) to cover an opening portion (3) of said vessel (2), a side wall (12) projecting from said top board (11) along axis (X) of said plug portion (4) which wall has an inner circumferential surface fits on an outer circumferential surface of said opening portion (3), and a cylindrical wall (15) forming a receiving chamber (14) having an opening mouth (13) at its under end face which wall projects from said top board (11) at inner side of said side wall (12), said seal plug (5) is to be fixed on said cylindrical wall (15) to seal said opening mouth (13) and its outer (D1) is larger than outer diameter (D2) of said cylindrical wall (15), said sleeve (6) is loosely fitted on said cylindrical wall (15) and has a flexible sepal portion (16) on said outer circumference which portion has outer diameter larger than inner diameter (D3) of said opening portion (3) and passes said inner diameter (D3) bending so as to avoid backward moving, and in relative movement to said vessel (2) toward direction to separate from said vessel (2), said seal plug (5) is separated by said sleeve (6) from said cylindrical wall (15) and said opening mouth (13) is to be opened, and wherein said opening portion (3) has a circular groove (7) and said sleeve (6) has a circular protruding portion (17) on outer circumferential face which portion engages with said circular groove (7).

9. A cap as claimed in claim 8 wherein said sleeve (6) has a flange (18) formed on its upper end surface which flange engage on an end surface (8) of said opening portion (3).

10. A cap as claimed in claim 8 wherein said sleeve (6) and said seal plug (5) are connected.

11. A cap as claimed in claim 8 wherein said sleeve (6), said scalping (5) and said vessel (2) are made of same material.

12. A cap as claimed in claim 10 wherein said sleeve (6), said seal plug (5), a connecting portion (19) of said sleeve (6) and said seal plug (5) and said vessel (2) are made of same material.

13. A sealing mechanism as claimed in claim 3 wherein said sleeve (6) and said seal plug (5) are connected.

14. A sealing mechanism as claimed in claim 3 wherein said sleeve (6), said seal plug (5) and said vessel (2) are made of same material.

15. A sealing mechanism as claimed in claim 13 wherein said sleeve (6), said seal plug (5), a connecting portion (19) of said sleeve (6) and said seal plug (5) and said vessel (2) are made of same material.

16. A cap as claimed in claim 9 wherein said sleeve (6) and said seal plug (5) are connected.

17. A cap as claimed in claim 9 wherein said sleeve (6), said seal plug (5) and said vessel (2) at made of same material.

18. A cap as claimed in claim 16 wherein said sleeve (6), said seal plug (5), a connecting portion (19) of said sleeve (6) and said seal plug (5) and said vessel (2) are made of same material.

* * * * *